United States Patent [19]

Bruneau

[11] 4,359,824

[45] Nov. 23, 1982

[54] PROTRACTOR UNIT FOR DRAWING-BOARD

[75] Inventor: Alain Bruneau, Montferrand le Chateau, France

[73] Assignee: Alpia S.A., France

[21] Appl. No.: 194,298

[22] PCT Filed: May 11, 1979

[86] PCT No.: PCT/EP79/00034

§ 371 Date: Jan. 15, 1980

§ 102(e) Date: Jan. 15, 1980

[87] PCT Pub. No.: WO79/01076

PCT Pub. Date: Dec. 13, 1979

[30] Foreign Application Priority Data

May 16, 1978 [FR] France ..... 78 15004

[51] Int. Cl.[3] ..... B43L 13/08

[52] U.S. Cl. ..... 33/438

[58] Field of Search ..... 33/438–442

[56] References Cited

U.S. PATENT DOCUMENTS 2,900,728 8/1959 Wallace ..... 33/439

*Primary Examiner*—Charles E. Phillips

*Attorney, Agent, or Firm*—Robert E. Burns; Emmanuel J. Lobato; Bruce L. Adams

[57] ABSTRACT

On the head of a conventional drawing apparatus, locking means consist of a toothed circular plate 1 integral with the support C, a toothed circular plate 2 integral with the turning handle and rule carrier, the plates 1,2 being concentric and rotating in a same plane, and a third toothed plate 3, forced towards the plates 1 and 2 by springs 4 so as to mesh with the plates 1 and 2 making them integral with each other. This plate 3 is movable axially along a hub E, while maintained perpendicular to the axis of said hub; it may be disengaged from the plates 1 and 2 by exerting a pressure on a pusher 5 which actuates a lever 6 which lifts a small plate 7 connected to the plate 3 by columns 8.

7 Claims, 3 Drawing Figures

PROTRACTOR UNIT FOR DRAWING-BOARD

FIELD OF INVENTION

The invention relates to drawing apparatus, particularly a protractor unit for drawing board, which comprises, on either side of a support, two portions interconnected by a hub extending through said support, which consist on the one hand of a rule carrier and on the other hand of a handle for rotatably driving the rule carrier and a graduated plate registering with at least one scale.

BACKGROUND OF THE INVENTION

The known apparatus comprises a number of predetermined angular positions, as a rule at 15-degree intervals, and the snap engagement in the selected position is obtained by engaging a pawl into a notch of a suitable crown.

Other manufacturers obtained this indexing function by means of balls urged by springs into holes disposed at spaced intervals along the periphery of a circular plate.

The known devices have in common the same difficulties to be solved:

the manufacture of precision notched wheels;

the elimination of operating play.

SUMMARY OF THE INVENTION

The scope of the present invention consists in providing an accurate ratchet device which can easily be engaged in each predetermined angular position, without play and with a long useful life, and the manufacture of which is not attended by specific difficulties.

To this end, the protractor unit according to the invention is characterised by the fact that each of the two relatively rotatable portions comprises a toothed circular plate concentric to its axis of rotation, turning in a same plane, each provided with the same number of radial teeth, and by the fact that a third circular plate, having the same number of teeth, concentric to the other two, is provided with means whereby its teeth can be interposed between those of the other plates, so as to lock the handle and rule carrier in a predetermined angular position relative to the support.

The essential advantage provided by the protractor unit according to the invention lies in the fact that the ratchet function is obtained by the engagement of all the teeth of the intermediate plate into all the teeth of the other two plates, thus warranting a high degree of precision free from play due to a long service.

BRIEF DESCRIPTION OF DRAWINGS

Other advantages will appear as the following description of a preferred but not limiting form of embodiment proceeds with reference to the drawing, in which.

DESCRIPTION OF PREFERRED EMBODIMENT

Figure 1:
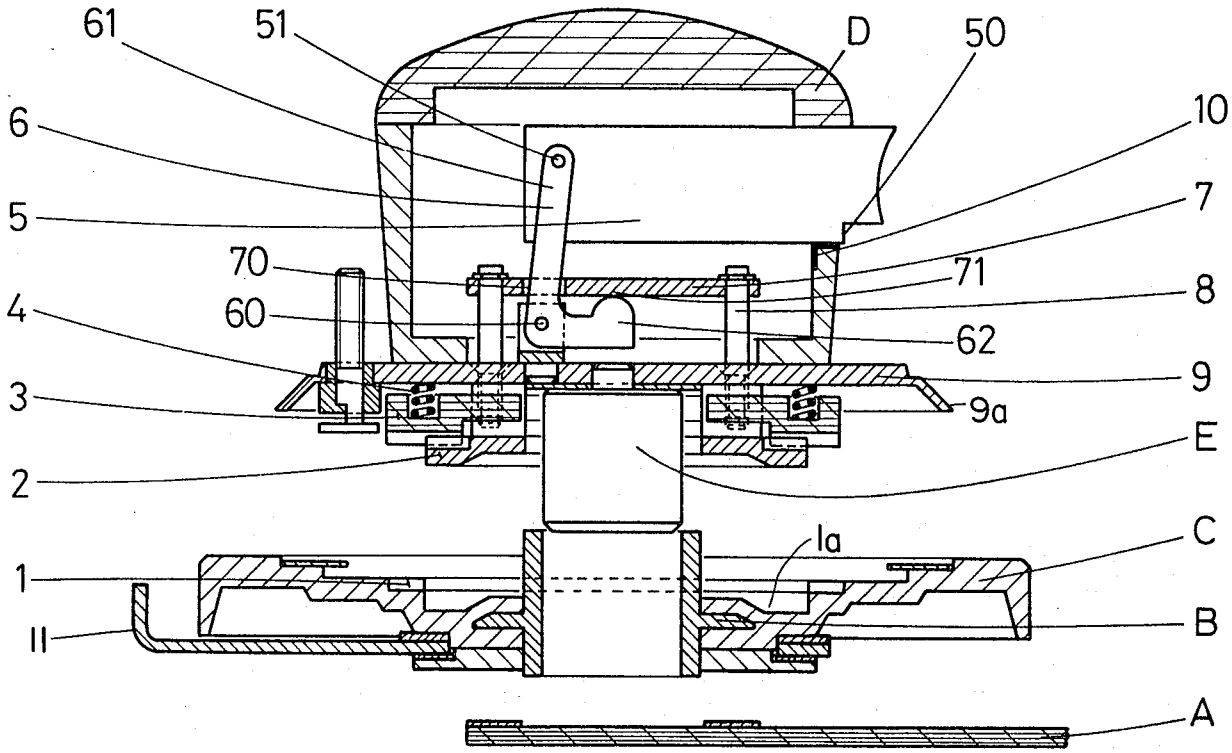
FIG. 1 is an exploded sectional view.

The protractor unit according to the invention consists essentially of a so-called fixed portion comprising a support C, the bearing socket B carried by a support C which is provided in turn with a toothed plate or gear 1, and of a turning portion comprising a handle D provided with a smaller toothed plate or gear 2 and connected with a rule carrier A by a hub E rotatable in the bearing socket B.

The toothed plates 1 and 2 are concentric to the hub E and plate 2 lies in an annular recess 1*a* in plate 1 so that the toothed portions of the plates lie in a common plane parallel to the rules.

A third toothed plate or gear 3 provided with the same number of teeth as, and concentric and parallel to plates 1 and 2 is, movable by springs 4 into meshing engagement with plates 1 and 2 making them integral with each other.

This plate 3, movable along the hub E, is suspended from a small plate 7 by means of columns 8 extending through the base 9 of control handle D and turning therewith as is conventional, at the periphery of the base 9 there is a graduated scale 9*a* cooperating with an index on the support C.

The upward or downward movements of plate 3 are obtained by means of a pressure exerted on a pusher 5 incorporated in the handle D. The translation of pusher 5 actuates a two-armed lever 6 having a bearing point 60 located on said base 9 beneath the small plate 7. The arm 61 of lever 6 is pivotally connected through a pivot pin 51 to pusher 5 and extends through an elongated aperture 70 formed in small plate 7 so that its short arm 62 bears against the centre 71 of small plate 7 and lifts same.

A notch 50 formed in pusher 5 permits maintaining the bearing force by inserting a latch 10 into said notch.

Thus the plate 3 can be held in its disengaged position to permit a faster rotation of the rules.

By releasing pusher 5' plate 3 will be pushed towards the fixed plate 1 by springs 4 and the teeth of one plate will mesh with those of the other plate and simultaneously with the teeth of the pivoting plate 2. The ratchet in the selected predetermined position will be maintained by all the teeth of plates 1,2,3 of which the surfaces in mutual contact are proportional to the number of teeth, this constituting a substantial advantage in comparison with the latch means of hitherto known apparatus.

Whatever the angle selected for the ratchet action, all the teeth of plates 1,2,3 are engaged and this is attended by a high degree of precision and a very satisfactory reliability.

Figure 2:
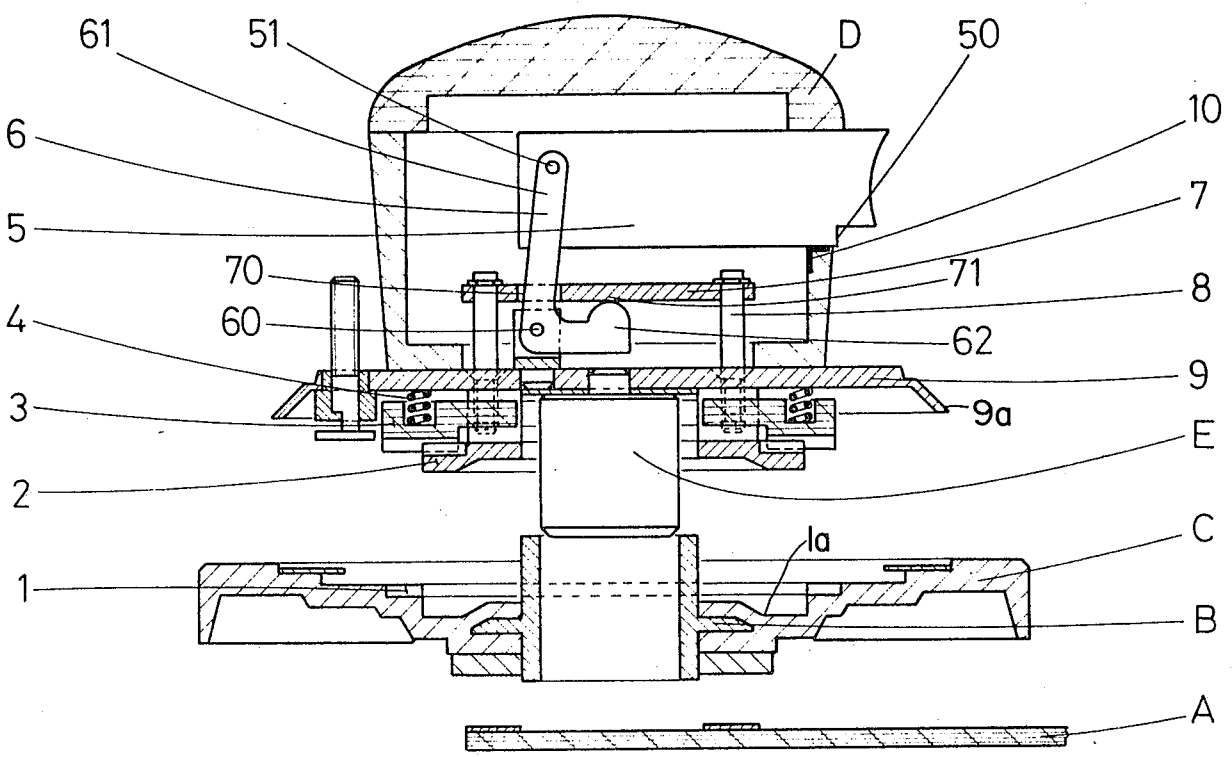
FIG. 2 is an exploded section showing a modified form of embodiment.
Figure 3:
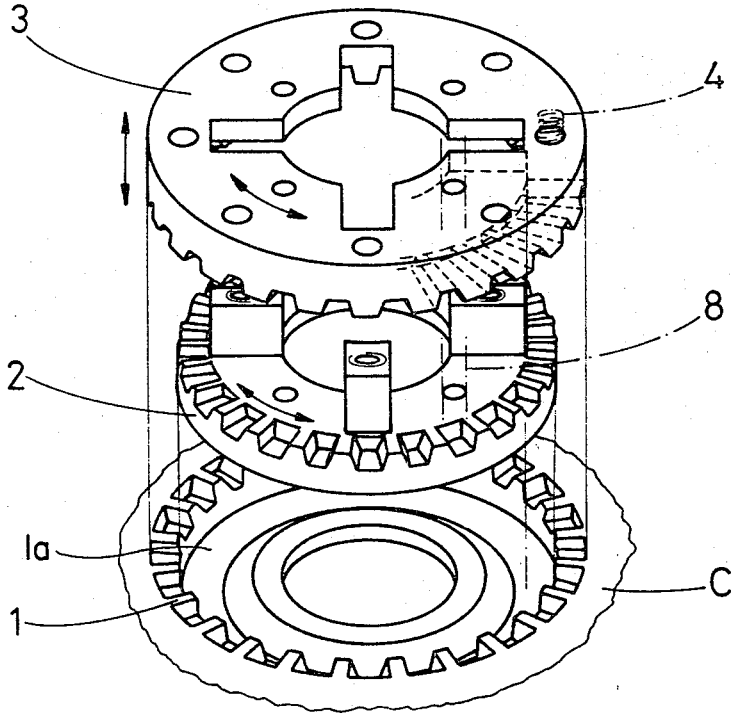
FIG. 3 is an exploded perspective view of the ratchet means.

FIG. 1 illustrates a form of embodiment of the invention which comprises an orientable zero by rotation of the support C relative to a primary support 11. FIG. 2 illustrates a modification without this feature.

In both cases disclosed herein, the width of the teeth of intermediate plate 3 is equal to the sum of the width of the teeth of the other two plates 1 and 2.

The contact surfaces of the teeth of the intermediate plate 3 is substantially equal to the sum of the surfaces of the teeth of the other two plates 1,2.

I claim:

1. Protractor unit for a drawing board, comprising a support having a bearing socket, an annular recess around said bearing socket and a first annular gear adjacent said recess and concentric with said bearing socket, said gear having radial teeth, a rule carrier below said support, a handle above said support, a hub extending through said bearing socket and connecting said rule carrier with said handle, and a second annular gear fixed to said handle concentric with said bub and receivable in said annular recess of said support, said second annular gear having the same number and spacing of radial teeth as said first annular gear, and a movable third annular gear facing and concentric with said first and second annular gears and having the same number and spacing of radial teeth, and means for moving said third annular gear between an engaged position in which it meshes with said first and second annular gears to lock said first and second gears together and consequently to lock said handle and rule carrier in a selected angular position relative to said support and a disengaged position in which said handle and rule carrier are rotatable relative to said support.

2. Protractor unit according to claim 1, in which springs act on said third annular gear to urge it toward engaged position.

3. Protractor unit according to claim 2, in which said handle is hollow and in which said means for moving said third annular gear comprises a plate in said handle, columns connecting said plate with said third annular gear and a lever for raising said plate and thereby disengaging said third annular gear from said first and second annular gears.

4. Protractor unit according to claim 3, in which said lever is operable by a pusher slidable in said handle and pivotally connected with said lever.

5. Protractor unit according to claim 1, in which the width of the teeth of said third annular gear is equal to the sum of the widths of the teeth of said first and second annular gears.

6. Protractor according to claim 5, in which the contact area of the teeth of said third annular gear is substantially equal to the sum of the content area of the teeth of said first and second annular gears.

7. Protractor according to claim 1, comprising means for releasably retaining said third gear in disengaged position to permit free rotation of said handle and rule carrier relative to said support.

* * * * *